US009073177B2

(12) United States Patent
Li et al.

(10) Patent No.: US 9,073,177 B2
(45) Date of Patent: Jul. 7, 2015

(54) ABRASIVE ARTICLE COMPRISING ABRASIVE PARTICLES OF A COMPOSITE COMPOSITION

(71) Applicants: Lingyu Li, Shrewsbury, MA (US); Muthu Jeevanantham, Shrewsbury, MA (US); Andre Collin, Brussels (BE); Renaud Fix, Paris (FR)

(72) Inventors: Lingyu Li, Shrewsbury, MA (US); Muthu Jeevanantham, Shrewsbury, MA (US); Andre Collin, Brussels (BE); Renaud Fix, Paris (FR)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 77 days.

(21) Appl. No.: 13/954,400

(22) Filed: Jul. 30, 2013

(65) Prior Publication Data

US 2014/0033617 A1 Feb. 6, 2014

Related U.S. Application Data

(60) Provisional application No. 61/677,819, filed on Jul. 31, 2012, provisional application No. 61/678,230, filed on Aug. 1, 2012.

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09C 1/68*** | (2006.01) |
| ***C09K 3/14*** | (2006.01) |

(52) U.S. Cl.
CPC ..... *B24D 3/00* (2013.01)

(58) Field of Classification Search
USPC ..... 51/293, 307, 308, 309
See application file for complete search history.

(56) References Cited

U.S. PATENT DOCUMENTS

| | | | | |
|---|---|---|---|---|
| 345,604 | A | 7/1886 | Semper | |
| 2,248,990 | A | 7/1941 | Heany | |
| 2,290,877 | A | 7/1942 | Heany | |
| 2,563,650 | A | 8/1951 | Heinemann | |
| 3,387,957 | A | 6/1968 | Howard | |
| 4,452,911 | A | 6/1984 | Eccles et al. | |
| 5,143,522 | A * | 9/1992 | Gibson et al. | 51/295 |
| 6,348,076 | B1 * | 2/2002 | Canaperi et al. | 51/309 |
| 6,802,877 | B2 * | 10/2004 | Drury | 51/298 |
| 7,001,253 | B2 * | 2/2006 | Zhou et al. | 451/41 |
| 2007/0074456 | A1 | 4/2007 | Orlhac et al. | |
| 2008/0120917 | A1 * | 5/2008 | Kinsinger et al. | 51/308 |
| 2010/0301146 | A1 * | 12/2010 | Chang | 241/21 |
| 2014/0137482 | A1 * | 5/2014 | Li et al. | 51/309 |

* cited by examiner

*Primary Examiner* — James McDonough
(74) *Attorney, Agent, or Firm* — Abel Law Group, LLP; Joseph P. Sullivan

(57) ABSTRACT

An abrasive article including a body having a bond material and abrasive particles contained in the bond material, the abrasive particles including a composite composition having alumina ($Al_2O_3$), iron oxide ($Fe_2O_3$), and silica ($SiO_2$). The abrasive particles further include an aspect ratio of at least 1:1 and an average porosity in a range of about 0 vol % to not greater than about 15 vol %.

20 Claims, 4 Drawing Sheets

ABRASIVE ARTICLE COMPRISING ABRASIVE PARTICLES OF A COMPOSITE COMPOSITION

This application claims priority to and the benefit of U.S. Prov. App. No. 61/678,230, filed Aug. 1, 2012, and U.S. Prov. App. No. 61/677,819, filed Jul. 31, 2012, both of which are incorporated herein by reference in their entirety.

FIELD OF THE DISCLOSURE

The following is directed to abrasive articles, and particularly, bonded abrasive articles comprising abrasive particles comprising a composite composition.

DESCRIPTION OF THE RELATED ART

Abrasive wheels are typically used for cutting, abrading, and shaping of various materials, such as stone, metal, glass, plastics, among other materials. Generally, the abrasive wheels can have various phases of materials including abrasive grains, a bonding agent, and some porosity. Depending upon the intended application, the abrasive wheel can have various designs and configurations. For example, for applications directed to the finishing and cutting of metals, some abrasive wheels are fashioned such that they have a particularly thin profile for efficient cutting.

However, given the application of such wheels, the abrasive articles are subject to fatigue and failure. In fact, the wheels may have a limited time of use of less than a day depending upon the frequency of use. Accordingly, the industry continues to demand abrasive wheels capable of improved performance.

SUMMARY

An abrasive article may include a body having a bond material and abrasive particles contained in the bond material. The abrasive particles may include a composite composition having alumina ($Al_2O_3$), iron oxide ($Fe_2O_3$), and silica ($SiO_2$). The abrasive particles may further include an aspect ratio of at least 1:1 and an average porosity in a range of about 0 vol % to not greater than about 15 vol %.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
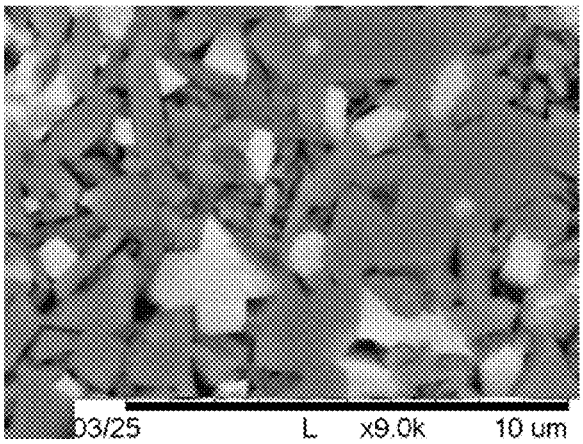
FIG. 1 includes a scanning electron microscope picture of an abrasive particle of a conventional sample.

The following is directed to abrasive tools having abrasive particles contained within a bond material for finishing, shaping, and/or conditioning workpieces. Certain embodiments herein are directed to bonded abrasive wheels, including large-diameter snagging wheels, that may be used for shaping of metal workpieces, including metals of titanium or stainless steel. However, the features of the embodiments herein may be applicable to other abrasive technologies, including for example, coated abrasives and the like.

The abrasive article can be formed by forming a mixture of components or precursor components that may be part of the final abrasive article. In one embodiment, the mixture can include abrasive particles. In a particular instance, the abrasive particles can have composite composition including alumina ($Al_2O_3$), iron oxide ($Fe_2O_3$), silica ($SiO_2$), calcia (CaO), titania ($TiO_2$) and the like. In certain circumstances, the composite composition can include a majority content of alumina. For example, the composite composition can have at least about 82% alumina for the total content of compounds (or elements) within the composite composition. In other instances, the content of alumina can be greater, such as at least about 83%, at least about 84%, at least about 85%, at least about 86%, or even at least about 87%, at least about 88%. Still, in at least one non-limiting embodiment, the composite composition can contain not greater than about 95% alumina, such as not greater than about 92% alumina, not greater than about 91% alumina, not greater than about 90% alumina, or even not greater than about 89% alumina. It will be appreciated that the composite composition can have a content of alumina within a range between any of the above noted minimum and maximum percentages.

According to one embodiment, the composite composition can have a minority content of silica. For example, in one instance, the composite composition can have a lesser content of silica as compared to the content of alumina. In a particular embodiment, the composite composition can have not greater than about 6.6% silica, such as not greater than about 6.5% silica, not greater than about 6% silica, not greater than about 5% silica, not greater than about 4% silica, or even not greater than about 3% silica. Still, in at least one non-limiting embodiment, the composite composition can have at least about 1% silica, such as at least about 2% silica, or even at least about 3% silica. It will be appreciated that the composite composition can have a content of silica within a range between any of the above noted minimum and maximum percentages.

In accordance with another embodiment, the composite composition can include a minority content of iron oxide. For example, the composite composition may include a lesser content of iron oxide as compared to the content of alumina. Furthermore, in other instances, the composite composition may have a lesser content of iron oxide as compared to the content of silica. Still, in another alternative embodiment, the composite composition can have a greater content of iron oxide as compared to the content of silica. For one particular embodiment, the composite composition of the abrasive particles can have not greater than about 7% iron oxide, such as not greater than about 6% iron oxide, not greater than about 5% iron oxide, not greater than about 4.5% iron oxide, or even not greater than about 4% iron oxide. Still, in other non-limiting examples, the composite composition may have at least about 1% iron oxide, such as at least about 2% iron oxide, or even at least about 3% iron oxide. It will be appreciated that the composite composition can have a content of silica within a range between any of the above noted minimum and maximum percentages.

Certain exemplary composite compositions of the abrasive particles may further include some content of titania ($TiO_2$). For example, one composite composition may include a minority content of titania. In other particular instances, the composite composition can have a lesser content of titania as compared to the content of alumina. In yet another embodiment, the composite composition can have a lesser content of titania as compared to the content of silica. And yet in another embodiment, the composite composition may have a lesser content of titania as compared to the content of iron oxide. For at least one non-limiting embodiment, the composite composition can have not greater than about 5% titania, such as not greater than about 4% titania. Still, for one non-limiting embodiment, the composite composition can include at least about 3.8% titania, such as at least about 3.9% titania. It will be appreciated that the composite composition can have a content of titania within a range between any of the above noted minimum and maximum percentages.

The composite composition may, in certain instances, include a content of calcia (CaO). For example, the composite composition may include a minority content of calcia. More specifically, in one particular embodiment, the composite composition can have a lesser content of calcia as compared to the content of alumina. Moreover, certain composite compositions can have a lesser content of calcia as compared to the content of silica. In yet another embodiment, the composite composition can include a lesser content of calcia as compared to the content of iron oxide. For one particular composite composition, the content of calcia can be less than the content of titania. According to one particular embodiment, the composite composition can have not greater than about 5% calcia, such as not greater than about 4% calcia, not greater than about 3% calcia, not greater than about 2% calcia, or even not greater than about 1% calcia. In at least one non-limiting embodiment, the composite composition can have at least about 0.3% calcia, such as at least about 0.4% calcia, at least about 0.5% calcia, at least about 0.6% calcia, or even at least about 0.7% calcia, at least about 0.8% calcia. It will be appreciated that the composite composition can have a content of calcia within a range between any of the above noted minimum and maximum percentages.

Certain composite compositions of the abrasive particles may also include some content of magnesia (MgO). According to one embodiment, the composite composition can include a minority content of magnesia. In particular instances, the composite composition can have a lesser content of magnesia as compared to the content of alumina. For another embodiment, the composite composition may have a lesser content of magnesia as compared to the content of silica. In accordance with another embodiment, the composite composition may have a lesser content of magnesia as compared to the content of iron oxide. In certain other instances, the composite composition may have a lesser content of magnesia as compared to the content of titania. Furthermore, the composite composition may have a lesser content of magnesia as compared to the content of calcia. Still, in at least one non-limiting embodiment, the composite composition can have a greater content of magnesia as compared to a content of calcia. According to one particular embodiment, the composite composition may have not greater than about 40% magnesia, such as not greater than about 30% magnesia, not greater than about 20% magnesia, not greater than about 15% magnesia, not greater than about 10% magnesia, not greater than about 8% magnesia, not greater than about 5% magnesia, or even not greater than about 2% magnesia. Still, in at least one non-limiting embodiment, the composite composition may include at least about 0.05% magnesia, such as at least about 0.1% magnesia. It will be appreciated that the composite composition can have a content of magnesia within a range between any of the above noted minimum and maximum percentages.

According to one embodiment, the composite composition can include a combination of alumina, silica, iron oxide, magnesia, calcia, and titania. In one aspect, the composition can be an ore, which has been mined and generally unrefined. According to one embodiment, the abrasive particles can be made of a crystalline material, and more particularly, can consist essentially of a crystalline material. In one particular embodiment, the composite composition can be bauxite, and more particularly, the abrasive particles may consist essentially of bauxite.

The abrasive particles may have other particular features. For example, the abrasive particles may have an elongated shaped. In particular instances, the abrasive particles may have an aspect ratio, defined as a ratio of the length:width of at least about 1:1, wherein the length is the longest dimension of the particle and the width is the second longest dimension of the particle (or diameter) perpendicular to the dimension of the length. In other embodiments, the aspect ratio of the abrasive particles can be at least about 2:1, such as at least about 2.5:1, at least about 3:1, at least about 4:1, at least about 5:1, or even at least about 10:1. In one non-limiting embodiment, the abrasive particles may have an aspect ratio of not greater than about 5000:1.

In at least one embodiment, the abrasive particles can be extruded, such that the composite composition is extruded and segmented to make abrasive particles of a desired size and shape. The abrasive particles may be sintered, and may be sintered in a particular manner to ensure certain properties and compositions described in the embodiments herein. According to one embodiment, the abrasive particles can be formed to have an ellipsoidal cross-sectional shape. An ellipsoidal shape can include circles, ellipses, and any other curvilinear shapes. Alternatively, in other instances, the abrasive particles can have a polygonal cross-sectional shape. Some suitable, non-limiting, examples of polygonal cross-sectional shapes include triangular, rectangular, pentagonal, hexagonal, septagonal, octagonal, and the like.

Embodiments of the abrasive particles may be characterized in terms of grain toughness (K1C) and hardness. For example, the hardness of the abrasive particles may be less than about 12 GPa. In some embodiments, the hardness of the abrasive particles may be less than about 11.5 GPa, such as less than about 11 GPa, less than about 10.5 GPa, less than about 10 GPa, or even less than about 9.5 GPa. In other embodiments, the hardness of the abrasive particles may be at least about 8.75 GPa, such as at least about 9 GPa, at least about 9.5 GPa, at least about 10 GPa, at least about 10.5 GPa, or even at least about 11 GPa. It will be appreciated that the abrasive particles can have a hardness within a range between any of the above noted minimum and maximum values.

Embodiments of the abrasive particles also can have a toughness of at least about 4.6 MPa-$m^{0.5}$. For example, the abrasive particles may have a toughness of at least about 4.7 MPa-$m^{0.5}$, such as at least about 4.8 MPa-$m^{0.5}$, at least about 4.9 MPa-$m^{0.5}$, or even at least about 5 MPa-$m^{0.5}$. In still other versions, the abrasive particles can have a toughness of not greater than about 5.4 MPa-$m^{0.5}$, such as not greater than about 5.3 MPa-$m^{0.5}$, not greater than about 5.2 MPa-$m^{0.5}$, not greater than about 5.1 MPa-m$^{0.5}$, or even not greater than about 5 MPa-m$^{0.5}$. It will be appreciated that the abrasive particles can have a toughness within a range between any of the above noted minimum and maximum values.

Regarding absolute values for single grain crush strength, the force (in newtons) required to break the grains may be given in terms of the percentage of the grains broken when subjected to breaking force. For example, in one embodiment, about 500 N to about 800 N may be required to break 50% of one or more types of the abrasive particles. In one embodiment, to break 50% of the abrasive particles, at least about 500 N, such as at least about 600 N, or even at least about 700 N is required. In another non-limiting embodiment no greater than about 1000 N is required to break the abrasive particles, such as no greater than about 900 N, or even no greater than about 800 N is required. It will be appreciated that each type of abrasive particle can have an absolute crush strength within a range between the above noted minimum and maximum values.

In another embodiment, in order to break 90% of each type of abrasive particle about 850 N to about 1350 N of force may be required. In one embodiment, to break 50% of the abrasive particles, at least about 800 N, such as at least about 850 N, or even at least about 900 N is required. In another non-limiting embodiment no greater than about 1500 N is required to break the abrasive particles, such as no greater than about 1400 N, or even no greater than about 1300 N is required. It will be appreciated that each type of abrasive particle can have an absolute crush strength within a range between the above noted minimum and maximum values.

According to one particular embodiment, the abrasive particles can have an average particle size of at least about 20 microns, such as at least about 50 microns, at least about 80 microns, at least about 100 microns, at least about 150 microns, at least about 200 microns, at least about 300 microns, at least about 400 microns, at least about 500 microns, at least about 600 microns, at least about 800 microns, at least about 1000 microns, at least about 1200 microns, at least about 1500 microns, at least about 1600 microns, at least about 1700 microns, or even at least about 1800 microns. Still, in another non-limiting embodiment, the abrasive particles can have an average particle size of not greater than about 10 mm, such as not greater than about 5 mm, not greater than about 4 mm, not greater than about 3 mm, not greater than about 2 mm, or even not greater than about 1 mm. It will be appreciated, that the average particle size may be determined by measuring and averaging the longest dimension (i.e., the length) of the particles. The abrasive particles can have an average particle size within a range between any of the minimum and maximum values noted above.

According to one embodiment, the abrasive particles can have a particular porosity, which may facilitate improved performance. For example, the average porosity of the abrasive particles can be at least about 0 vol % for the total volume of an abrasive particle. In one embodiment, the average porosity of the abrasive particles can be at least about 2 vol %, such as at least about 2.5 vol %, at least about 3 vol %, at least about 3.5 vol %, at least about 4 vol %, at least about 5 vol %, at least about 7 vol %, at least about 9 vol %, at least about 11 vol, or even at least about 13 vol %. Still, in one non-limiting embodiment, the average porosity of the abrasive particles may be not greater than about 15 vol %, such as not greater than about 14 vol %, not greater than about 12 vol %, not greater than about 10 vol %, not greater than about 8 vol %, not greater than about 6 vol %, not greater than about 4 vol %, not greater than about 2 vol %, or even not greater than about 1 vol % for the total volume of the abrasive particle. It will be appreciated that the average porosity of the abrasive particles can be within a range between any of the minimum and maximum percentages noted above.

Furthermore, the abrasive particles may have a particular average pore size. For example, the average pore size of the abrasive particles can be not greater than about 6 microns, such as not greater than about 5 microns, not greater than about 4 microns, not greater than about 3 microns, not greater than about 2 microns, or even not greater than about 1.5 microns. According to another non-limiting embodiment, the average pore size of the abrasive particles can be at least about 0.01 microns, such as at least about 0.1 microns. It will be appreciated that the average pore size of the abrasive particles can be within a range between any of the minimum and maximum percentages noted above.

The abrasive particles can be made of crystalline grains. In particular instances, the abrasive particles can include crystalline grains having a median grain size of not greater than about 1.2 microns. In other instances, the median grain size can be not greater than about 1 micron, such as not greater than about 0.9 microns, not greater than about 0.8 microns, or even not greater than about 0.7 microns. According to one non-limiting embodiment, the median grain size of the abrasive particles can be at least about 0.01 microns, such as at least about 0.05 microns, at least about 0.1 microns, at least about 0.2 microns, or even at least about 0.4 microns. It will be appreciated that the median grain size of the abrasive particles can be within a range between any of the minimum and maximum percentages noted above.

Crystalline grain size was measured from SEM micrographs. Grains are embedded in epoxy blocks and then polished to obtain a flat cross-section. The cross-sections are then etched by HF acid for two minutes to reveal the fine microstructure and measure the median grain size.

As described herein, in addition to the abrasive particles, the mixture may also include other components or precursors to facilitate formation of the abrasive article. For example, the mixture may include abrasive particles and a bond material. According to one embodiment, the bond material may include a material selected from the group consisting of an organic material, an organic precursor material, an inorganic material, an inorganic precursor material, a natural material, and a combination thereof. In particular instances, the bond material may include a metal or metal alloy, such as a powder metal material, or a precursor to a metal material, suitable for formation of a metal bond matrix material during further processing.

According to another embodiment, the mixture may include a vitreous material, or a precursor of a vitreous material, suitable for formation of a vitreous bond material during further processing. For example, the mixture may include a vitreous material in the form of a powder, including for example, an oxygen-containing material, an oxide compound or complex, a frit, and any combination thereof.

In yet another embodiment, the mixture may include a ceramic material, or a precursor of a ceramic material, suitable for formation of a ceramic bond material during further processing. For example, the mixture may include a ceramic material in the form of a powder, including for example, an oxygen-containing material, an oxide compound or complex, and any combination thereof.

According to another embodiment, the mixture may include an organic material, or a precursor of an organic material, suitable for formation of an organic bond material during further processing. Such an organic material may include one or more natural organic materials, synthetic organic materials, and a combination thereof. In particular instances, the organic material can be made of a resin, which may include a thermoset, a thermoplastic, and a combination thereof. For example, some suitable resins can include phenolics, epoxies, polyesters, cyanate esters, shellacs, polyurethanes, rubber, and a combination thereof. In one particular embodiment, the mixture includes an uncured resin material configured to form a phenolic resin bond material through further processing.

In some embodiments, the resin may have a high temperature flexure modulus of at least 1.05. Alternatively, the resin may have an increasing high temperature flexural modulus. The phenolic resin may be modified with a curing or cross-linking agent, such as hexamethylene tetramine. At temperatures in excess of about 90° C., some examples of the hexamethylene tetramine may form crosslinks to form methylene and dimethylene amino bridges that help cure the resin. The hexamethylene tetramine may be uniformly dispersed within the resin. More particularly, hexamethylene tetramine may be uniformly dispersed within resin regions as a cross-linking agent. Even more particularly, the phenolic resin may contain resin regions with cross-linked domains having a sub-micron average size.

Other materials, such as a filler, can be included in the mixture. The filler may or may not be present in the finally-formed abrasive article. The filler may include a material selected from the group consisting of powders, granules, spheres, fibers, and a combination thereof. Moreover, in particular instances, the filler can include an inorganic material, an organic material, and a combination thereof. In a certain embodiment, the filler can include a material such as sand, bubble alumina, chromites, magnesite, dolomites, bubble mullite, borides, titanium dioxide, carbon products (e.g., carbon black, coke or graphite), silicon carbide, wood flour, clay, talc, hexagonal boron nitride, molybdenum disulfide, feldspar, nepheline syenite, glass spheres, glass fibers, $CaF_2$, $KBF_4$, Cryolite ($Na_3AlF_6$), potassium Cryolite ($K_3AlF_6$), pyrites, ZnS, copper sulfide, mineral oil, fluorides, carbonates, calcium carbonate, and a combination thereof, wherein the filler comprises a material selected from the group consisting of an antistatic agent, a lubricant, a porosity inducer, coloring agent, and a combination thereof. In particular instances wherein the filler is particulate material, it may be distinct from the abrasive particles, being significantly smaller in average particle size than the abrasive particles.

After forming the mixture the process of forming the abrasive article can further include forming a green body comprising abrasive particles contained in a bond material. A green body is a body that is unfinished and may undergo further processing before a finally-formed abrasive article is formed. Forming of the green body can include techniques such as pressing, molding, casting, printing, spraying, and a combination thereof. In one particular embodiment, forming of the green body can include pressing the mixture into a particular shape, including for example, conducting a cold isostatic pressing operation to form a green body in the form of a grinding wheel.

After forming the green body, the process can continue by treating the green body to form a finally-formed abrasive article comprising a body. Some suitable examples of treating can include curing, heating, sintering, crystallizing, polymerization, pressing, and a combination thereof. In one example, the process may include bond batching, mixing abrasive with bond, filling a mold, pressing, wheel baking or curing, finishing, inspection, speed testing, and packing and shipping.

After treating the abrasive article is formed to have a body including a particular content of bond material. For example, the body can have at least about 30 vol % bond material for the total volume of the body. In other instances, the content of bond material in the body can be greater, such as at least about 35 vol %, at least about 40 vol %, at least about 45 vol %, at least about 50 vol %, at least about 55 vol %, at least about 60 vol %, or even at least about 65 vol %. Still, in at least one non-limiting embodiment, the content of bond material in the body can be not greater than about 70 vol %, such as not greater than about 65 vol %, not greater than about 60 vol %, not greater than about 55 vol %, not greater than about 50 vol %, not greater than about 45 vol %, not greater than about 40 vol %, or even not greater than about 35 vol %. It will be appreciated that the content of bond material in the body can be within a range between any of the minimum and maximum percentages noted above.

According to a particular embodiment, the body can have a particular content of porosity. For example, the body can have not greater than about 40 vol % porosity for the total volume of the body. In a particular instance, the body can have not greater than about 35 vol %, such as not greater than about 30 vol %, not greater than about 25 vol %, not greater than about 20 vol %, not greater than about 15 vol %, not greater than about 10 vol %, not greater than about 8 vol %, not greater than about 5 vol %, not greater than about 4 vol %, or even not greater than about 3 vol % porosity. According to one non-limiting embodiment, the body can have at least about 0.05 vol % porosity, such as at least about 0.5 vol % porosity, at least about 1 vol %, at least about 2 vol %, at least about 3 vol %, at least about 5 vol %, at least about 10 vol %, at least about 15 vol %, at least about 20 vol %, or even at least about 30 vol %. It will be appreciated that the porosity of the body can be within a range between any of the minimum and maximum percentages noted above.

For certain abrasive articles of the embodiments herein, the body can have a particular content of abrasive particles. For example, in one embodiment, the body can include at least about 30 vol % abrasive particles for the total volume of the body. In another embodiment, the body can have at least about 35 vol %, at least about 40 vol %, at least about 45 vol %, at least about 50 vol %, at least about 55 vol %, at least about 60 vol %, or even at least about 65 vol % abrasive particles. In at least one non-limiting embodiment, the body can have a content of abrasive particles of not greater than about 70 vol %, such as not greater than about 65 vol %, not greater than about 60 vol %, not greater than about 55 vol %, not greater than about 50 vol %, not greater than about 45 vol %, not greater than about 40 vol %, or even not greater than about 35 vol %. It will be appreciated that the content of abrasive particles in the body can be within a range between any of the minimum and maximum percentages noted above.

The abrasive articles of the embodiments herein can have a body that may be in the form of a bonded abrasive having a shape such as a hone, a cone, a cup, flanged shapes, a cylinder, a wheel, a ring, and a combination thereof. In one particular embodiment, the body can be a bonded abrasive snagging wheel.

According to one embodiment, the abrasive article may be particularly suited for grinding and conditioning of workpieces. Certain suitable workpieces can include inorganic materials, and more particularly workpieces made of a metal or metal alloy. According to one embodiment, the abrasive article may be particularly suited to grind materials such as stainless steel or titanium.

In one particular embodiment, the body of the abrasive article can be configured to conduct a room temperature metal grinding operation on a workpiece at a Q-ratio, which is a measure of weight (lbs.) of material removed from the workpiece divided by weight (lbs.) of material lost from the body of the abrasive article, of at least about 30. In other embodiments, the Q-ratio can be greater, such as at least about 16, at least about 18, at least about 20, or even at least about 22. Still, in one non-limiting embodiment, the Q-ratio of the body for a room temperature metal grinding operation can be not greater than about 30.

According to another embodiment, the body of the abrasive article can be configured to conduct a high temperature metal grinding operation on a workpiece at a Q-ratio, which is a measure of weight (lbs.) of material removed from the workpiece divided by weight (lbs.) of material lost from the body of the abrasive article, of at least about 38. In other embodiments, the Q-ratio can be greater, such as at least about 25, at least about 27, at least about 29, or even at least about 21. Still, in one non-limiting embodiment, the Q-ratio of the body for a high temperature metal grinding operation can be not greater than about 40.

EXAMPLES

Three samples were tested including a conventional sample (CS1), a first sample (S1) representative of an embodiment herein, and a second sample (S2) representative of an embodiment herein. Sample CS1 is a grinding wheel having 63.64 vol % abrasive particles of bauxite, 32.54 vol % bond material of phenolic resin. The abrasive particles may vary from about 35 vol % to about 70 vol % of a total volume content of the abrasive portion of the wheel. Sample CS1 includes Alodur 92, which is a Treibacher grain, Rod 92.

The bond material comprised a BZ8 bond, commercially available from Saint-Gobain Corporation, having the following formulation. The bond may comprise 52 vol % phenolic resin 29-722, 25 vol % iron pyrite, 12 vol % $K_2SO_4$—KCl, 3 vol % saran, and 8 vol % lime, of a total volume of the abrasive portion of the wheel.

The test conditions for some embodiments included grinding 409SS slab workpieces at 150 HP. The material removal rate (MRR) at room temperature (cold) was 240 kg/hr, and 350 to 400 kg/hr at 300° C. to 400° C. (warm). The corresponding Q-ratios were 22 at room temperature (cold) and 31 at 300° C. to 400° C. (warm).

FIG. 1 is a scanning electron microscope picture of the abrasive particles of the conventional sample CS1. Moreover, FIG. 2 includes a plot 201 of distribution versus micron size and the median crystal size of the crystals in the abrasive particles used in sample CS1. The distribution of crystal sizes was measured using SEM method on a polished cross-section of grain and then image analysis of the SEM micrographs.

Figure 3:
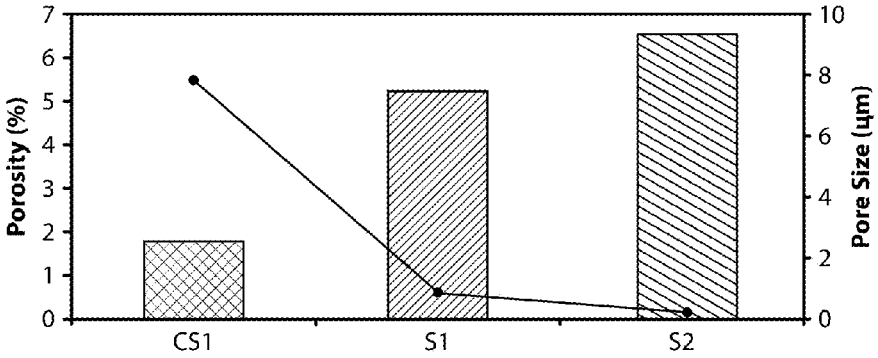
FIG. 3 includes plots of average porosity and pore size for abrasive particles of a conventional sample and samples according to embodiments.

Moreover, the abrasive particles of sample CS1 had an average pore size of approximately 8 microns and an average porosity of approximately 1.7 vol %. FIG. 3 includes plots of average porosity and pore size for the abrasive particles of the conventional sample as well as samples S1 and S2. The average pore size was measured using a mercury porosimetry technique. In addition, the average porosity of the abrasive particles was measured using the mercury porosimetry technique.

The mercury porosimetry technique characterizes the porosity of a material by applying various level of pressure to a sample immersed in mercury. The pressure required to intrude mercury into the sample's pores are inversely proportional to the pore size. This technique provides information for open pores where mercury can intrude, not the closed pores of a sample. Equipment suitable for porosity measurements is made by Micromeritics Instrument Corp. Associated with this technique are the ASTM standards D4404-84(2004) Standard Test Method for Determination of Pore Volume and Pore Volume Distribution of Soil and Rock by Mercury Intrusion Porosimetry; and D4284-07 Standard Test Method for Determining Pore Volume Distribution of Catalysts by Mercury Intrusion Porosimetry.

The testing parameters may include mercury porosimetry with the AutoPore IV 9500 V1.07, with port 2/1. The sample comprised 250-20 sintered bauxite and had a sample weight of 20.2125 g. The evacuation pressure was 50 um Hg, the evacuation time was 5 minutes, the Hg filling pressure was 0.9 psia, and the equilibrium time was 8 seconds.

Sample S1 is a grinding wheel having 63.64 vol % abrasive particles of bauxite commercially available from Alcan, 32.54 vol % bond material of phenolic resin. Table 1 includes the composition of each type of sintered bauxite, including embodiments S1 (SO250), S2 (210), CS1 (Alodur 92) and CS2 (SO200).

| Samples | | Chemical composition (wt %) | | | | | |
|---|---|---|---|---|---|---|---|
| | | $Fe_2O_3$ | $TiO_2$ | $SiO_2$ | CaO | MgO | $Al_2O_3$ |
| std | CS2 | 3.4 | 3.8 | 2.7 | 0.9 | 0.1 | 88.5 |
| Examples | S1 | 3.1 | 3.9 | 2.8 | 0.8 | 0.1 | 89.2 |
| | S2 | 4.4 | 4.0 | 2.2 | 0.8 | 0.2 | 84.7 |
| std | CS1 | 8.7 | 7 | 3.8 | 0.2 | 0.1 | 79.5 |

Figure 2:
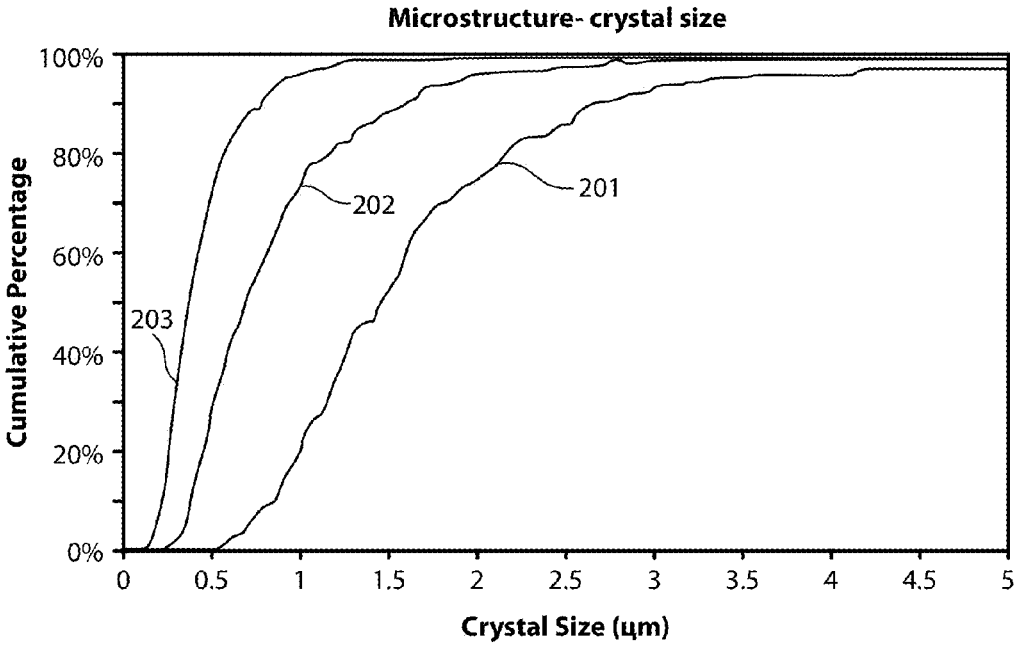
FIG. 2 includes plots of distribution versus micron size and the median crystal size for abrasive particles of a conventional sample and samples according to embodiments.
Figure 4:
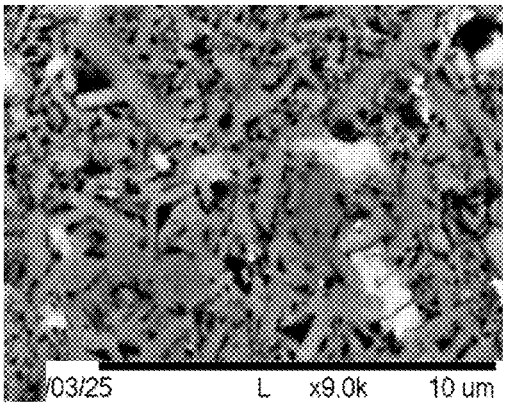
FIG. 4 includes a scanning electron microscope picture of an abrasive particle of a sample according to an embodiment.

FIG. 4 is a scanning electron microscope picture of the abrasive particles of sample S1. FIG. 2 includes a plot 202 of distribution versus micron size and the median crystal size of the crystals in the abrasive particles used in sample S1. Moreover, the abrasive particles of sample S1 had an average pore size of 1.2 microns and an average porosity of approximately 5%, using the techniques noted above for sample CS1.

Figure 5:
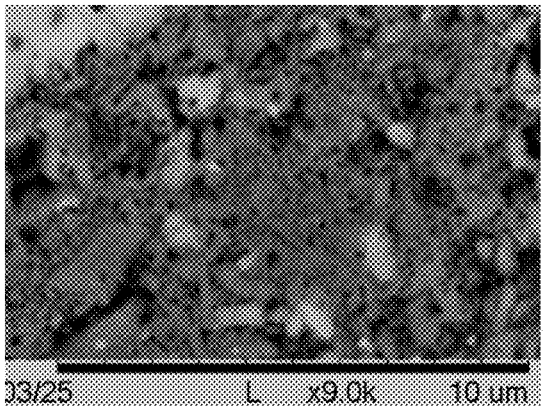
FIG. 5 includes a scanning electron microscope picture of an abrasive particle of a sample according to an embodiment.

Sample S2 is a grinding wheel having the same volume percentages of abrasive particles of bauxite and bond material of phenolic resin described above for samples CS1 and S1. FIG. 5 is a scanning electron microscope picture of the abrasive particles of sample S2. As noted above, FIG. 2 includes a plot 203 of distribution versus micron size and the median crystal size of the crystals in the abrasive particles used in sample S2. The distribution of crystal sizes was measured using the SEM image analysis method. Moreover, the abrasive particles of sample S2 had an average pore size of less than approximately 0.5 microns and an average porosity of approximately 6.7%, using the techniques noted above for sample CS1.

Figure 6:
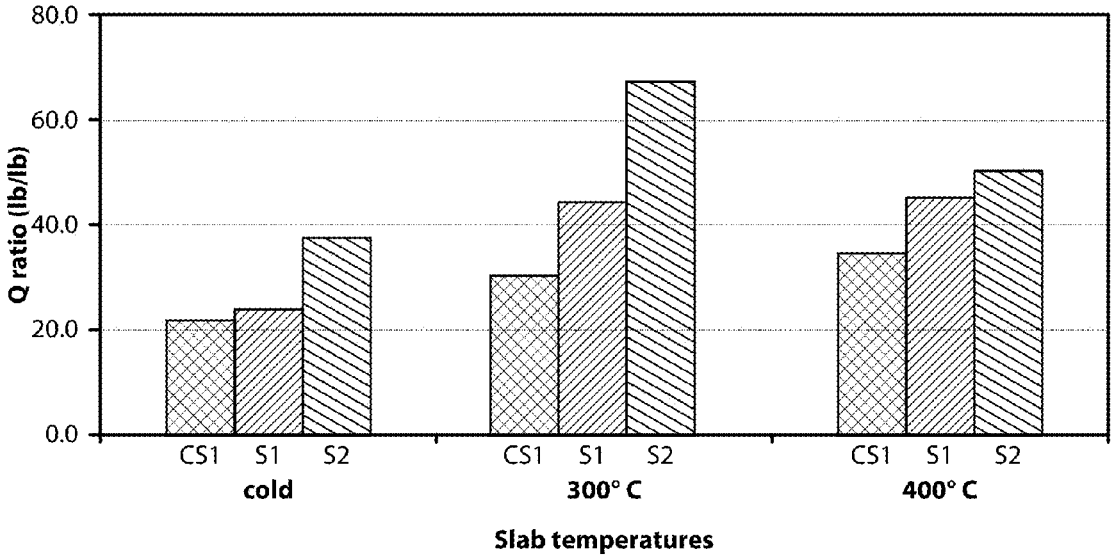
FIG. 6 includes plots of Q-ratio for samples conducting stainless steel grinding tests at various temperatures for a conventional sample and samples representative of embodiments herein.

FIG. 6 includes plots of Q-ratio for samples conducting stainless steel grinding tests at various temperatures for a conventional sample and samples representative of embodiments herein. As illustrated, during the room temperature (i.e., slab temperature "cold") grinding test under the conditions noted herein, Samples S1 and S2 demonstrated improved performance over the conventional sample. In fact, sample S2 demonstrated at least an 80% improvement in Q-ratio over sample CS1. Moreover, for the other high temperature grinding tests (i.e., slab temperatures of 300° C. and 400° C.), samples S1 and S2 demonstrated even greater improvement over the conventional sample. Notably, samples S2 had over a 100% increase in Q-ratio as compared to sample CS1 at 300° C. Moreover, both samples S1 and S2 had at least a 15% improvement in the Q-ratio over sample CS1 at 400° C.

Embodiments of the abrasive particles may be characterized in terms of grain toughness (K1C) and hardness. Hardness may be tested with a Vickers Indentation hardness test as known to those of ordinary skill in the art. In this test, an indent is made on the polished surface of the grain and diagonal distances are measured on the impression. K1C may be performed by indentation fracture on a Mitutoyo device. The load may be 0.5 kg, and the elastic modulus may be 410 GPa.

Table 2 includes toughness and hardness measurements made for four different samples. Conventional sample CS1 is Alodur 92, and samples S1, S2 and S3 are SO 250, 210 and 203 of abrasive particles in accordance with embodiments herein.

TABLE 2

| | K1C (MPa $m^{1/2}$) | Hardness (GPa) |
|---|---|---|
| CS1 | 4.57 +/− 0.5 | 12.32 +/− 0.26 |
| S1 | 4.98 +/− 0.16 | 9.24 +/− 0.49 |
| S2 | 5.02 +/− 0.29 | 9.36 +/− 0.43 |
| S3 | 4.51 +/− 0.59 | 11.26 +/− 0.57 |

Figure 7:
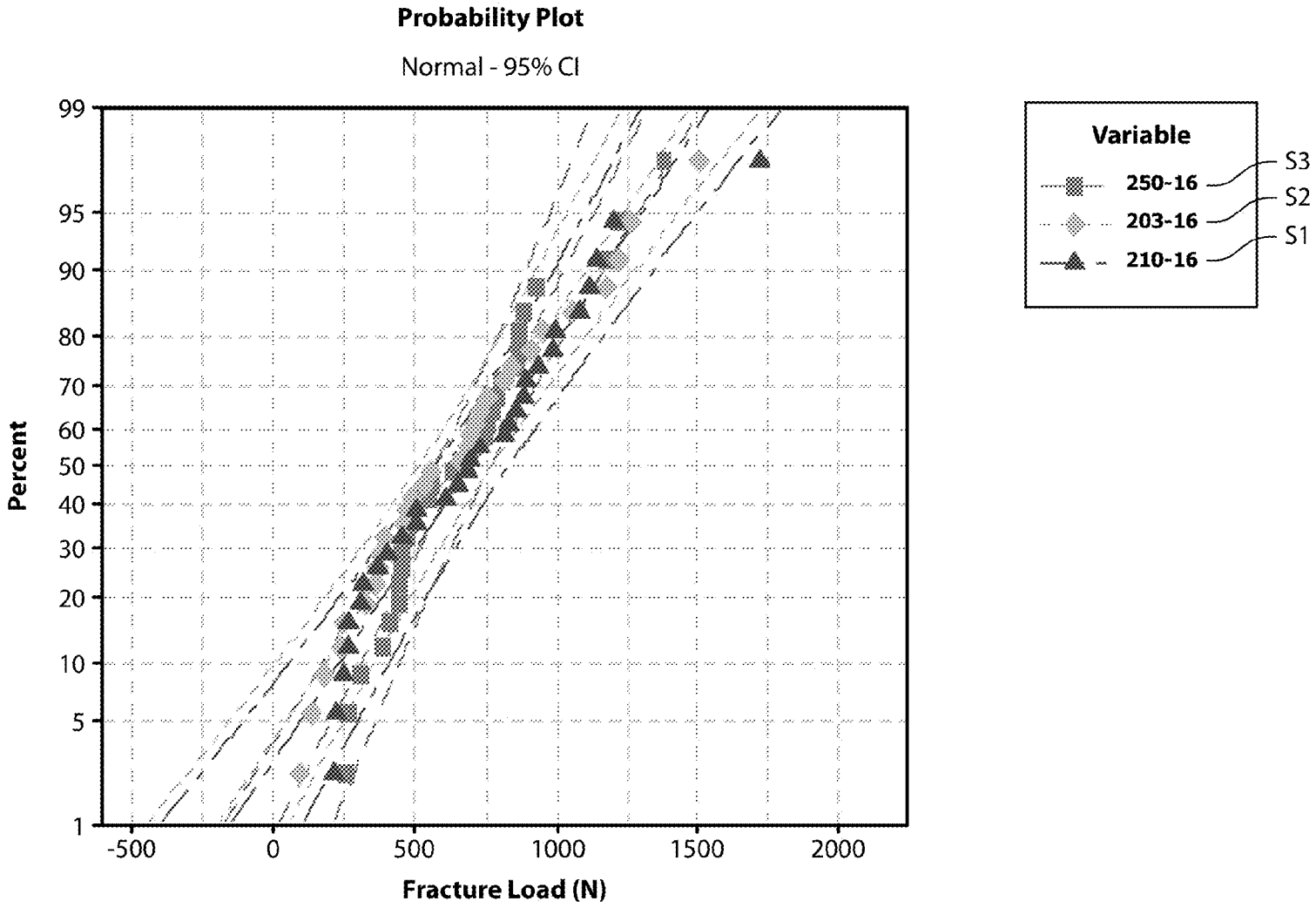
FIG. 7 includes a plot of includes a plot comparing the grain crush strength of three embodiments of abrasive articles.

FIG. 7 is a Weibull probability plot for a grain crush strength test of the three samples, S1, S2 and S3, which comprise the following grades of sintered bauxite: 210-16, 203-16, and 250-16, respectively.

For this test, the test frame was MTS Sintech 2/G, the test method was single grain crush, the fixture had carbide platens with a load cell of 1000 lbs, and the test speed was 2 μm/sec. The single grain crush test was conducted on a Sintech 2/G machine, commercially available from MTS Corporation. A 16 grit-size particle was prepared and placed between two platens of polycrystalline diamond. A 1000 lb load cell was selected for a compression method test using Testworks software on the Sintech 2/G machine. The compression test was initiated by selecting a test speed of 2 microns/second and a pre-load of less than 2 N. The test is completed when the grain is sufficiently fractured under the load cell and the force necessary to fracture is determined by the Sintech 2/G machine. At least 30 grains were tested and a Weibull plot was generated, such as the plot illustrated in FIG. 7, herein.

In FIG. 7, the horizontal x-axis depicts the force (in newtons) required to break the grains. The vertical y-axis depicts the percentage of the grains broken when subjected to breaking force. 95% confidence intervals (CI) are indicated by the lines surrounding each of the two sets of plotted data. To compare the grain crush strength of each sample, representative measurements may be made at both 50% of the grains broken, and at 90% of the grains broken. For example, at the 50% interval, the lower 95% confidence interval for S11 is about 600 N, and the upper 95% confidence interval for S11 is about 800 N. At the 50% interval, the lower 95% confidence interval for S12 is about 500 N, and the upper 95% confidence interval for S12 is about 750 N. Also at the 50% interval, the lower 95% confidence interval for S13 is about 550 N, and the upper 95% confidence interval for S13 is about 800 N.

At the 90% interval, the lower 95% confidence interval for S11 is about 950 N, and the upper 95% confidence interval for S11 is about 1350 N. At the 90% interval, the lower 95% confidence interval for S12 is about 900 N, and the upper 95% confidence interval for S12 is about 1300 N. Also at the 90% interval, the lower 95% confidence interval for S13 is about 850 N, and the upper 95% confidence interval for S13 is about 1300 N. Thus, the three types of grains have similar crush strengths and friability.

The processes and abrasive articles disclosed herein represent a departure from the state-of-the-art. Abrasive articles herein can utilize a combination of features, such as abrasive particle having certain features, including but limited to, composition, average pore size, average porosity, average crystal size, crystal shape, and a combination thereof. Moreover, the abrasive articles may utilize additional features such as bond material, content of bond material, content of abrasive particles, fillers, and the like. While not entirely understood, the combination of features facilitates the formation of abrasive articles that have demonstrated unexpected and remarkable improved performance.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive article comprising:

a body including:

a bond material; and abrasive particles contained in the bond material, the abrasive particles comprising a composite composition including alumina ($Al_2O_3$), iron oxide ($Fe_2O_3$), and silica ($SiO_2$), the abrasive particles further comprising an aspect ratio of at least 1:1 and an average porosity in a range of about 0 vol % to not greater than about 15 vol %.

2. The abrasive article of claim 1, wherein the abrasive particles comprise an average particle size of at least about 20 microns, and not greater than about 10 mm.

3. The abrasive article of claim 1, wherein abrasive particles have a hardness of less than about 12 GPa, and at least about 8.75 GPa.

4. The abrasive article of claim 1, wherein the abrasive particles have a toughness (K1C) of at least about 4.6 MPa-$m^{0.5}$, and not greater than about 5.4 MPa-$m^{0.5}$.

5. The abrasive article of claim 1, wherein the abrasive particles have an ellipsoidal cross-sectional shape.

6. The abrasive article of claim 1, wherein the abrasive particles further comprise an average pore size of not greater than about 6 microns, and at least about 0.01 microns.

7. The abrasive article of claim 1, wherein the abrasive particles comprise crystalline grains, and wherein the crystalline grains have a median grain size of not greater than about 1.2 microns, and at least about 0.01 microns.

8. The abrasive article of claim 1, wherein the body is configured to conduct a room temperature metal grinding operation on a workpiece at a Q-ratio of at least about 16, and not greater than about 30.

9. The abrasive article of claim 1, wherein the body is configured to conduct a high temperature metal grinding operation on a workpiece at a Q-ratio of at least about 25, and not greater than about 40.

10. The abrasive article of claim 1, wherein, to break 50% of the abrasive particles, at least about 500 N, and no greater than about 1000 N is required.

11. The abrasive article of claim 1, wherein, to break 90% of the abrasive particles, at least about 800 N, and no greater than about 1500 N is required.

12. An abrasive article comprising:

a body including:

a bond material; and abrasive particles contained in the bond material, the abrasive particles comprising a composite composition including alumina ($Al_2O3$), iron oxide ($Fe_2O_3$), and silica ($SiO_2$), the abrasive particles comprising an average porosity of at least about 2 vol % and not greater than about 15 vol %, and further comprising an average pore size of not greater than about 6 microns.

13. The abrasive article of claim 12, wherein the abrasive particles comprise an average particle size of at least about 20 microns and not greater than about 10 mm.

14. The abrasive article of claim 12, wherein the abrasive particles are elongated and comprise an aspect ratio of at least 2:1.

15. The abrasive article of claim 12, wherein the abrasive particles comprise crystalline grains, and wherein the crystalline grains have a median grain size of not greater than about 1.2 microns, and at least about 0.01 microns.

16. A bonded abrasive article comprising:

a body including:

a bond material;

abrasive particles contained in the bond material, the abrasive particles comprising a composite composition including alumina ($Al_2O_3$), iron oxide ($Fe_2O_3$), and silica ($SiO_2$), the abrasive particles further comprising an elongated shape having an aspect ratio of at least about 2:1; and wherein the body is configured to conduct a room temperature metal grinding operation on a workpiece at a Q-ratio of at least about 30.

17. The abrasive article of claim 12, wherein the abrasive particles comprise bauxite.

18. The abrasive article of claim 12, wherein the abrasive particles comprise an average pore size of at least about 0.1 microns and not greater than about 2 microns.

19. The abrasive article of claim 12, wherein the abrasive particles comprise an average porosity of at least about 3 vol % and not greater than about 8 vol %.

20. The abrasive article of claim 12, wherein the abrasive particles comprise, bauxite, an average pore size of at least about 0.1 microns and not greater than about 2 microns, and an average porosity of at least about 3 vol % and not greater than about 8 vol %.

* * * * *